US006859127B1

(12) United States Patent
Lin

(10) Patent No.: US 6,859,127 B1
(45) Date of Patent: Feb. 22, 2005

(54) DEVICE FOR COMBINING ANNULAR TRANSFORMERS WITH A MACHINE HOUSING

(76) Inventor: Heng Sheng Lin, No. 995, Dadun Rd., Nantun District, Taichung City 408 (TW)

( * ) Notice: Subject to any disclaimer, the term of this patent is extended or adjusted under 35 U.S.C. 154(b) by 0 days.

(21) Appl. No.: 10/697,112

(22) Filed: Oct. 31, 2003

(51) Int. Cl.[7] ..... H01F 27/02

(52) U.S. Cl. ..... 336/90; 336/65; 336/92; 336/98; 336/105; 174/50; 174/48

(58) Field of Search ..... 336/90, 92, 98, 336/65; 219/760, 235, 685, 756; 174/50, 18, 66, 52.1, 67

(56) References Cited

U.S. PATENT DOCUMENTS 5,177,325 A * 1/1993 Giammanco ..... 174/50
5,739,736 A * 4/1998 Lee ..... 336/65
6,683,249 B1 * 1/2004 Leppin ..... 174/50

* cited by examiner

*Primary Examiner*—Lincoln Donovan
*Assistant Examiner*—Jennifer A. Poker
(74) *Attorney, Agent, or Firm*—Troxell Law Office, PLLC

(57) ABSTRACT

A device for combining annular transformers with a machine housing includes a bolt to fix annular transformers on a machine housing and a saucer-shaped plate assembled on the outer side of the machine housing. The saucer-shaped plate is bored with a central insert hole for the bolt to pass therethrough and has its outer annular portion formed with a first plane and its inner annular portion formed with a second plane higher than the first one. The two planes are connected by an annular conical portion contracting gradually toward its upper side to be positioned in the machine housing. The bolt is orderly inserted through the saucer-shaped plate, the machine housing and the annular transformers to fix securely the annular transformers on the machine housing. The bolt has its head completely positioned in the conical portion of the saucer-shaped plate, not protruding out of the machine housing.

4 Claims, 5 Drawing Sheets

DEVICE FOR COMBINING ANNULAR TRANSFORMERS WITH A MACHINE HOUSING

BACKGROUND OF THE INVENTION

1. Field of the Invention

This invention relates to a device for combining annular transformers with a machine housing, particularly to one able to stably combine annular transformers with a machine housing.

2. Description of the Prior Art

Generally, transformers are installed in electric products or electronic instruments to produce a proper working voltage, and among various kinds of transformers, a hollow annular transformer is commonly employed. Conventionally, to combine hollow annular transformers with a machine housing, as shown in FIGS. 1 and 2, firstly, the annular transformers 2 are piled and positioned on the machine housing 3 and two rubber sup port cushions 6 for protection are respectively provided on the upper and the lower side of the annular transformer 2, and then a plate iron 7 for reinforcement is positioned on the topmost side of the upper annular transformers 2. Next, an elongate bolt 1 is orderly inserted upward through the insert hole 4 of the machine housing 3, the annular transformer(s) 2, the two rubber support cushions 6 and the plate iron 7 and then locked by a nut 5 to fix the annular transformer(s) 2 on the machine housing 3.

However, the conventional method for combining annular transformer with a mac hine housing as described above has the following drawbacks.

1. After the bolt 1 is locked, the head of the bolt 1 is exposed to the outer side of the machine housing 3 so it will spoil the smooth and beautiful appearance of the machine housing 3 and may collide with something to make the machine housing 3 deformed or the bolt 1 unstable and even cause damage or short circuit to the annular transformer(s) 2 when the machine housing 3 is transported and moved about.

2. Since the bolt 1 only contacts with the circumferential edge of the insert hole 4 of the machine housing 3, stress is excessively concentrated and the circumferential edge of the insert hole 4 of the machine housing 3 is likely to become deformed because of bearing too heavy a weight, and the bolt 1 and the transformer(s) 2 may become unstable and fall off.

SUMMARY OF THE INVENTION

The objective of the invention is to offer a device for combining annular transformers with a machine housing, able to stably combine at least one annular transformer with a machine housing and maintain the smooth and beautiful appearance of the machine housing.

The device for combining annular transformers with a machine housing in the present invention is provided with an elongate bolt to fix annular transformers on a machine housing. The machine housing is bored with an insert hole, and the bolt is inserted through the insert hole of the machine housing and the annular transformers and then locked by a nut to fixedly combine the annular transformers with the machine housing.

The feature of the invention is a saucer-shaped plate positioned on the outer side of the machine housing. The saucer-shaped plate is bored with an insert hole in the center for the bolt to be inserted therethrough and has its outer annular portion formed with a first plane and its inner annular portion formed with a second plane higher than the first one. The first and the second plane of the saucer-shaped plate are connected by an annular conical portion contracting gradually toward its upper side. The conical portion of the saucer-shaped plate is inserted through the insert hole of the machine housing and positioned in the interior of the machine housing. Thus, after the bolt is orderly inserted upward through the saucer-shaped plate, the machine housing and the annular transformers and locked by the nut to fix the annular transformers on the machine housing, the head of the bolt can be completely positioned and hidden in the space under the conical portion of the saucer-shaped plate, not protruding out of the machine housing.

BRIEF DESCRIPTION DRAWINGS

This invention will be better understood by referring to the accompanying drawings, wherein.

DETAILED DESCRIPTION OF THE PREFERRED EMBODIMENT

Figure 1:
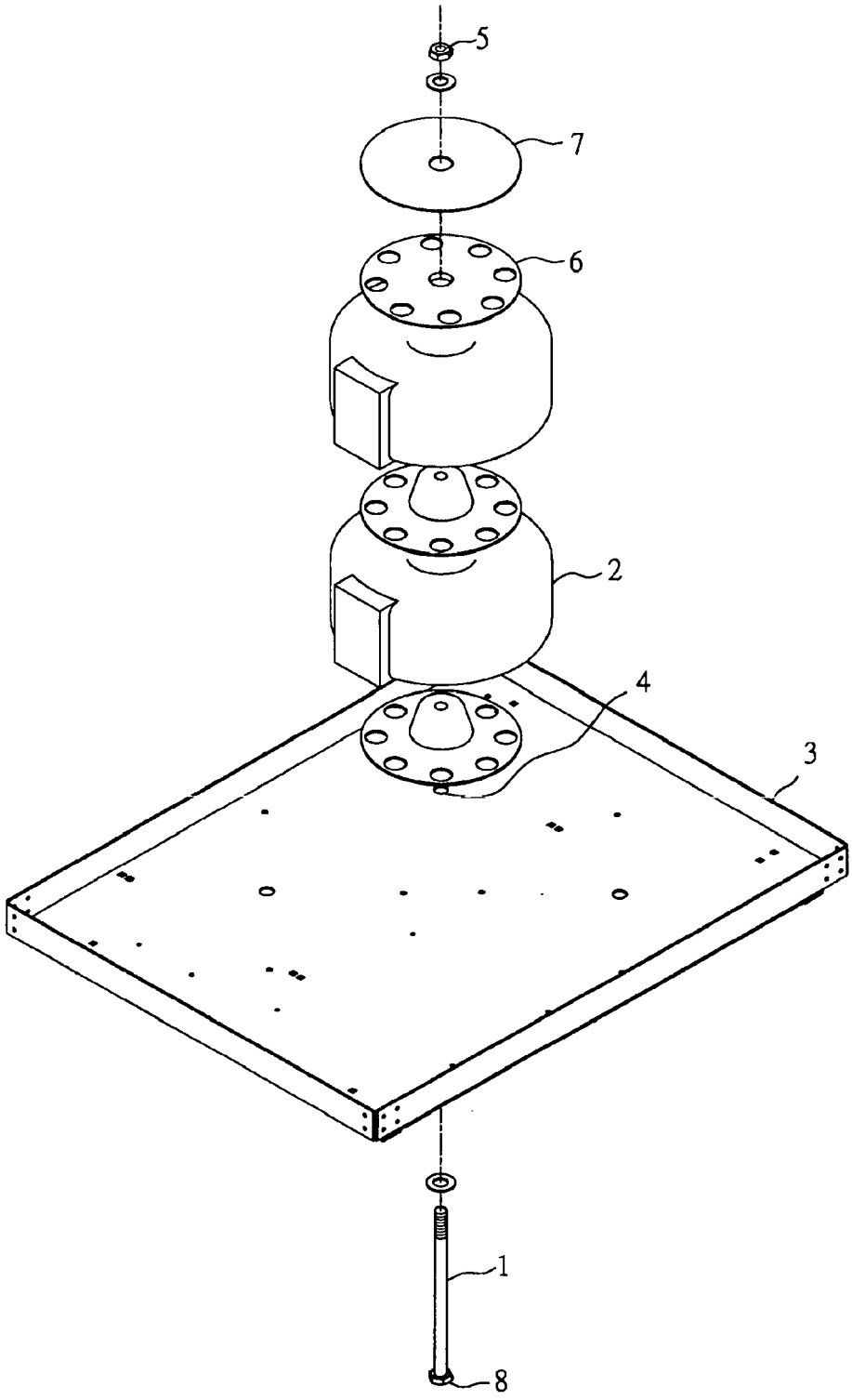
FIG. 1 PRIOR ART
FIG. 1 is an exploded perspective view of conventional annular transformers and a machine housing separated from each other.
Figure 2:
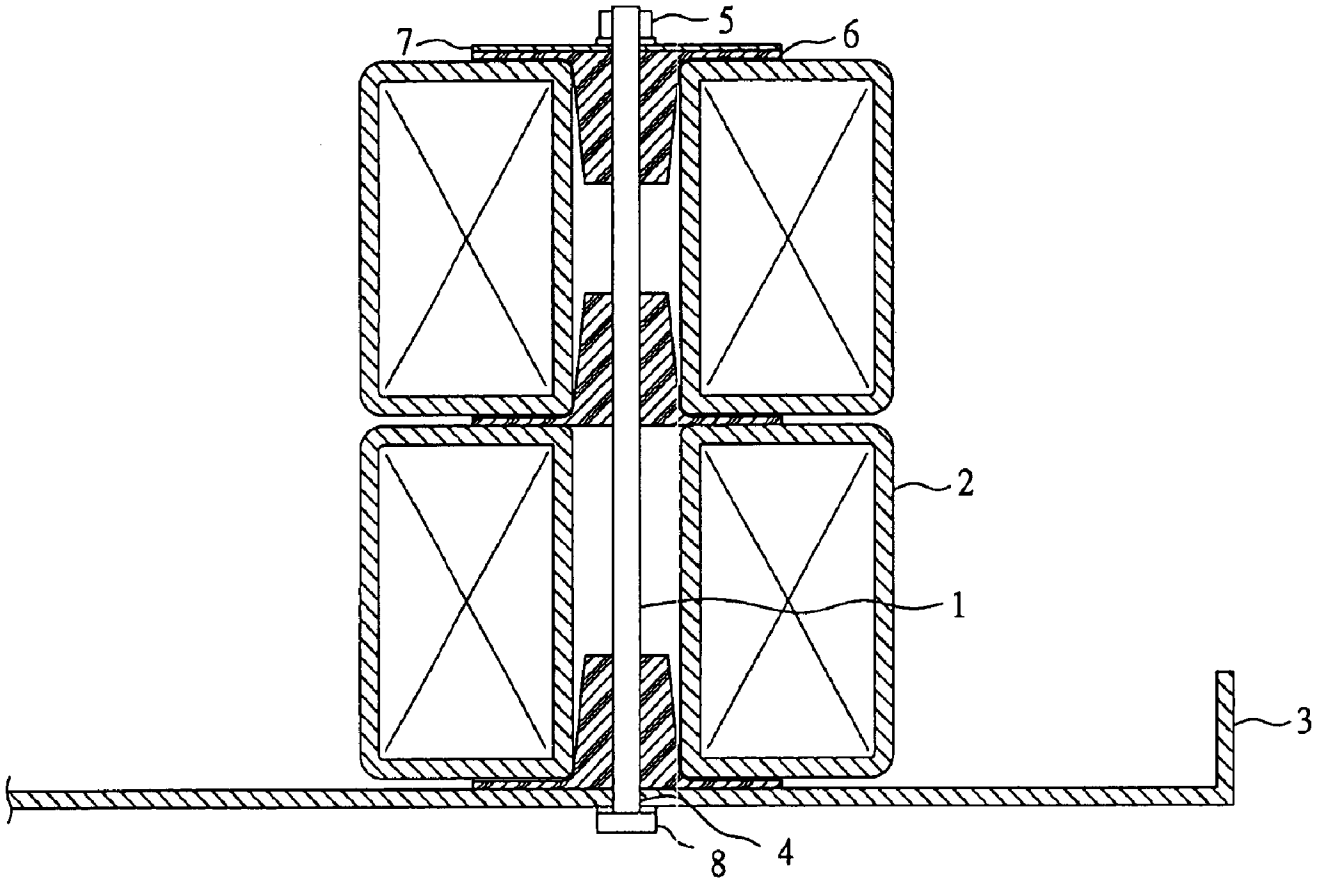
FIG. 2 PRIOR ART
FIG. 2 is a cross-sectional view of the conventional annular transformers and machine housing combined together.
Figure 3:
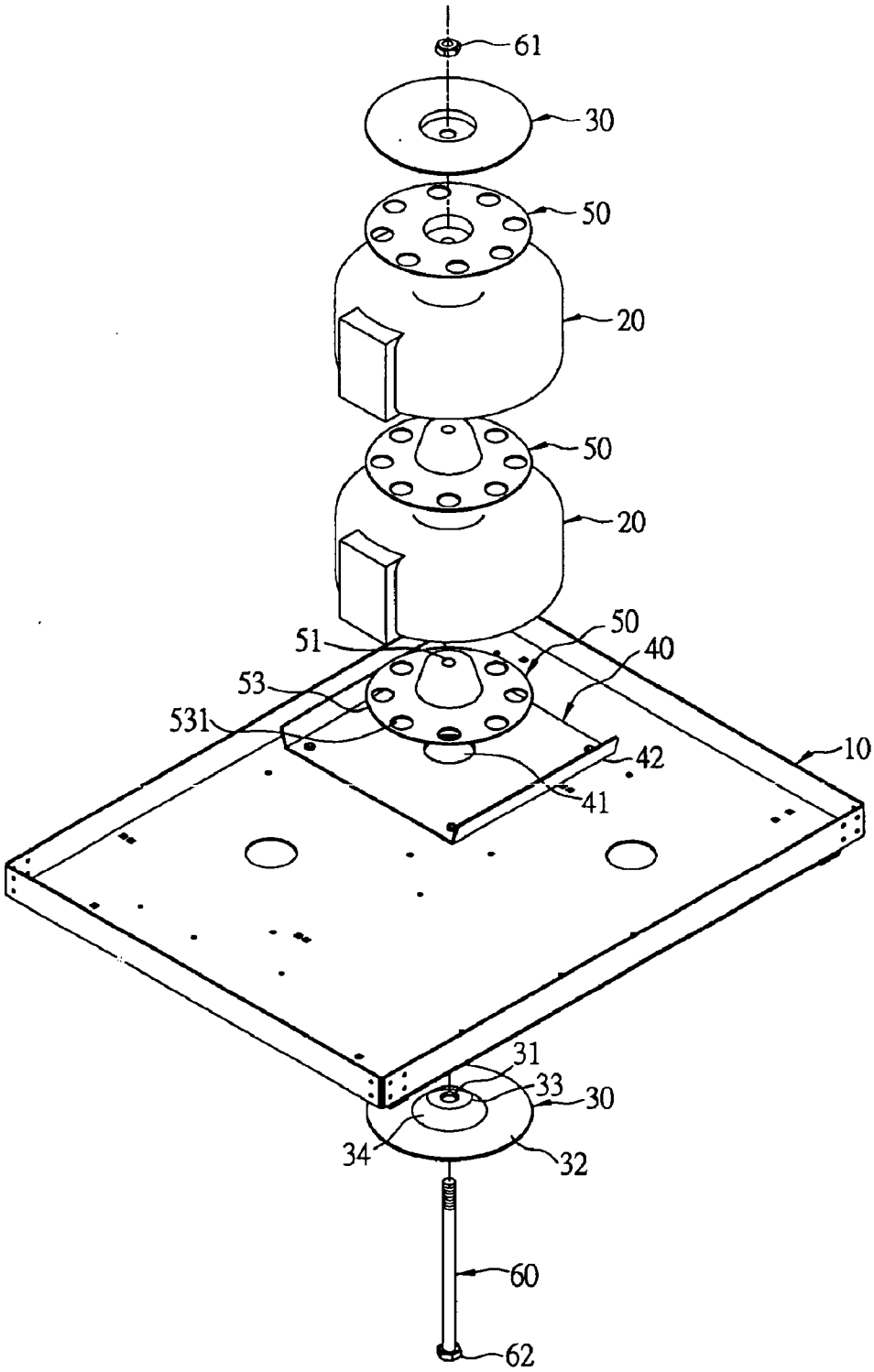
FIG. 3 is an exploded perspective view of annular transformers and a machine housing in the present invention.
Figure 4:
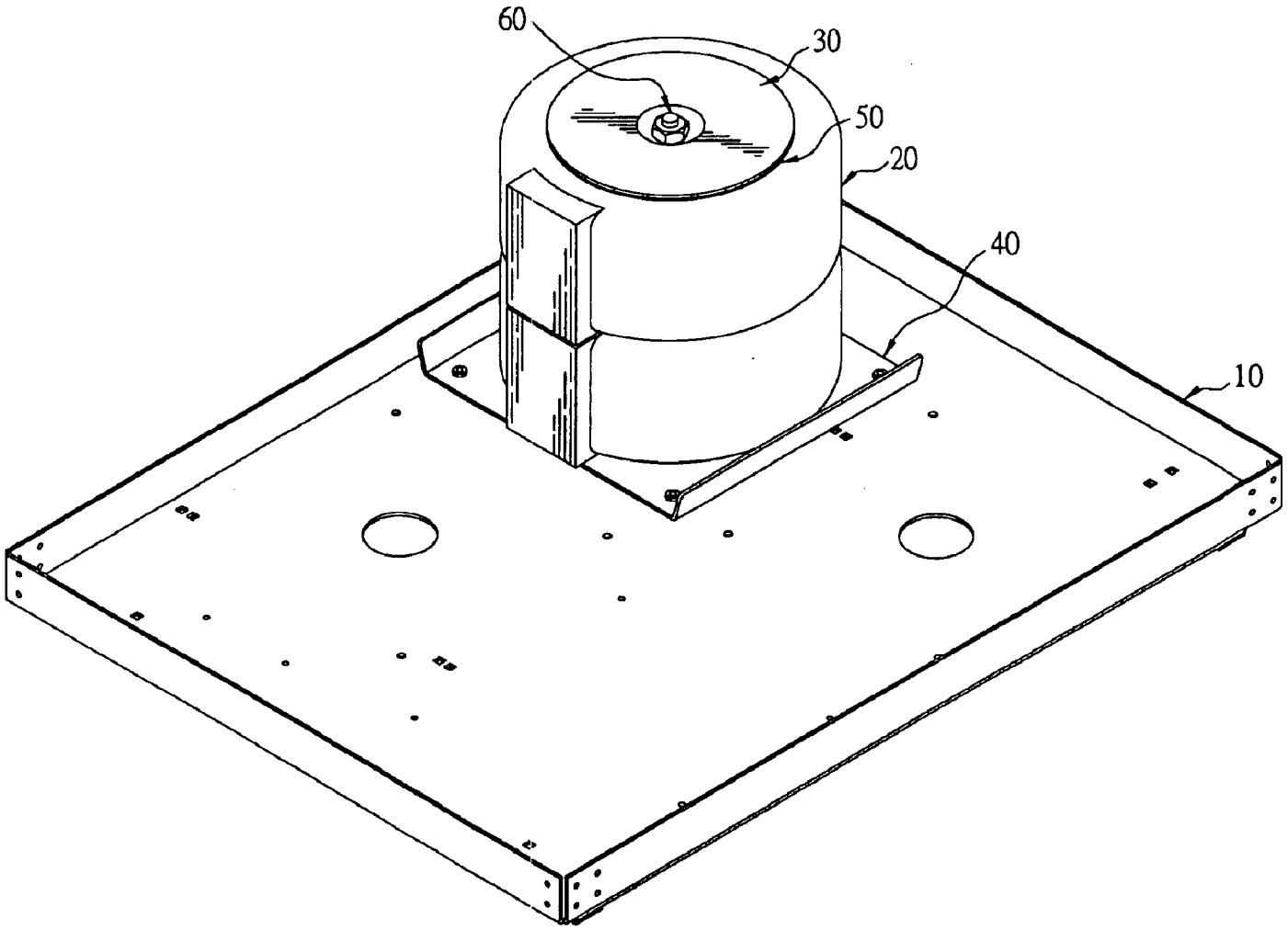
FIG. 4 is a perspective view of the annular transformers and the machine housing combined together in the present invention.
Figure 5:
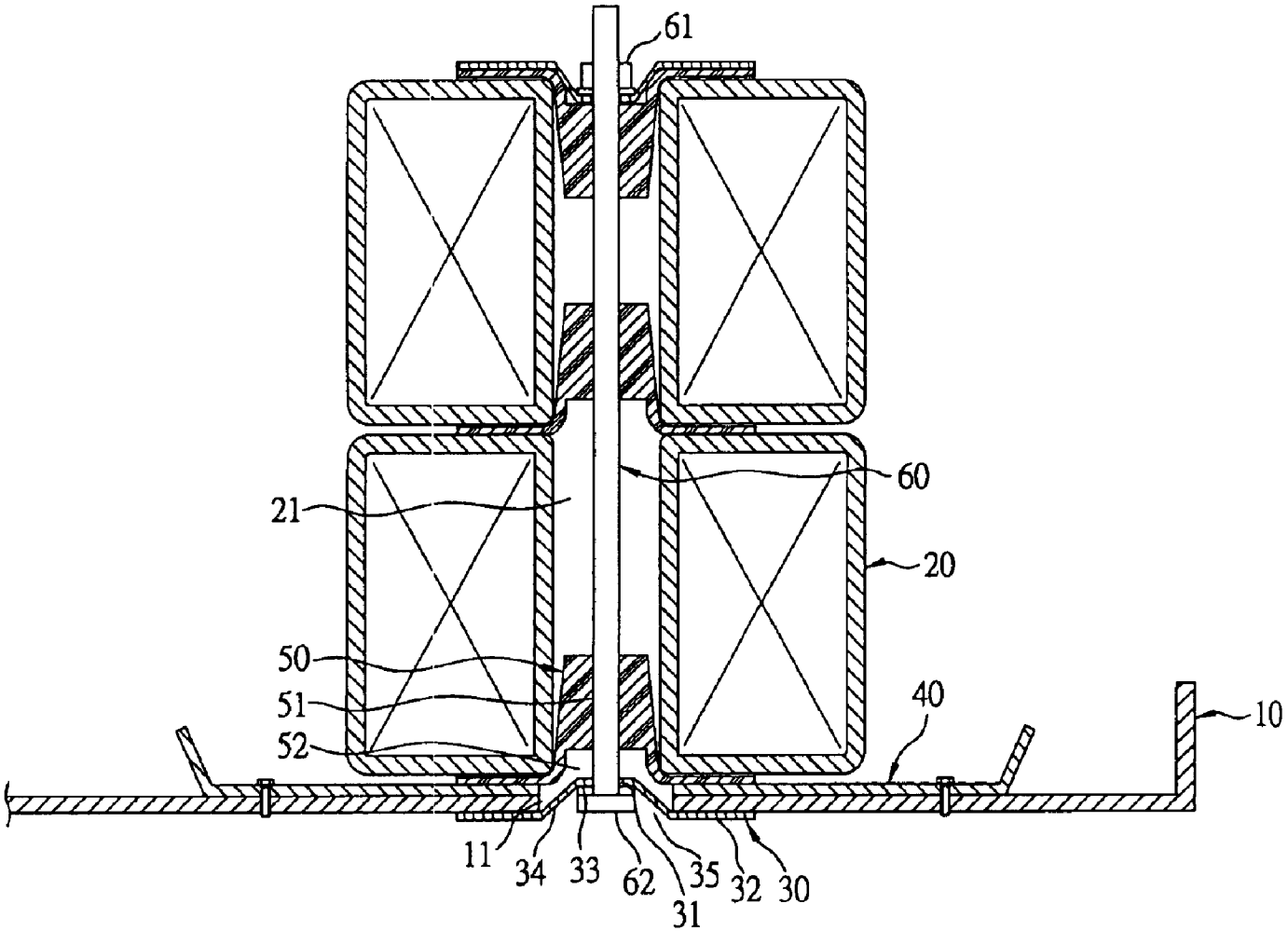
FIG. 5 is a cross-sectional view of the annular transformers and the machine housing combined together in the present invention.

A preferred embodiment of a device for combining annular transformers with a machine housing in the present invention, as shown in FIGS. 3, 4 and 5, includes a machine housing 10, at least one annular transformer, two saucer-shaped plates 30, a reinforced plate 40, at least one support cushion 50 and an elongate bolt 60 combined together.

The machine housing 10 is provided with an insert hole 11 with a preset diameter.

The annular transformers 20 combined with the machine housing 10 are respectively provided with a vertical through hole 21 in the center.

One of the two saucer-shaped plates 30 is positioned at the outer side of the machine housing 10 and the other is inversely positioned on the topmost side of the upper annular transformers 20. Each saucer-shaped plate 30 shaped as a disk is made of a iron plate with a proper thickness and has an insert hole 31 bored in the center and aligned to the through hole 21 of the annular transformer 20. Further, each saucer-shaped plate 30 has its outer annular portion formed with a first plane 32 with a certain area and its inner annular portion formed with a second plane 33 higher than the first plane 32. The first and the second planes 32, 33 are connected by an annular conical portion 34 contracting gradually toward its upper side. The conical section 34 of the saucer-shaped plate 30 is received in the insert hole 11 of the machine housing 10, with an accommodating space 35 formed under the conical section 34 and the second plane 33 of the saucer-shaped plate 30.

The reinforced plate 40 shaped rectangular is positioned between the machine housing 10 and the lower annular transformer 20, bored in the center with an insert hole 41 facing the insert hole 11 of the machine housing 10, and having a diameter equivalent to that of the insert hole 11. Further, the reinforced plate 40 has its opposite sides respectively bent upward to form a low sidewall 42 for strengthening its structure.

The support cushions 50 are respectively made of rubber and shaped as a cone to be inserted in the through hole 21 of the annular transformer 20. Each support cushion 50 has a vertical through hole 51 bored in the center and a recess 52 formed under for receiving the center portion of the saucer-shaped plate 30 therein. Each support cushion 50 has its outer annular portion 53 having a plurality of through holes 531 spaced apart for dispersing heat. A first support cushion 50 is positioned between the reinforced plate 40 and the lower annular transformer 20, a second one is positioned between two annular transformers 20 and a third one is inversely positioned between the topmost side of the upper annular transformer 20 and the upper saucer-shaped plate 30.

The elongate bolt 60 with a head 62 is orderly inserted upward through the insert holes 11, 31, 41 of the machine housing 10, the saucer-shaped plates 30 and the reinforced plate 40, and passing through the through holes 21, 51 of the annular transformers 20 and the support cushions 50 and then screwed with a nut 61 to fix above-mentioned components securely on the machine housing 10, having its head 62 completely positioned and hidden in the accommodating space 35 under the conical section 34 of the lower saucer-shaped plate 30.

In assembling, as show-n in FIGS. 4 and 5, firstly, the boat 60' is orderly inserted upward through the lower saucer-shaped plate 30, the machine housing 10, the reinforced plate 40, the annular transformers 20, the support cushion 50 and the upper saucer-shaped plate 30. Next, the bolt 60 has its upper end screwed with the nut 61 to fix the above-mentioned components on the machine housing 10. Thus, the lower saucer-shaped plate 30 has its first plane 32 closely pushing against the outer side of the machine housing 10, its conical section 34 completely inserted in the insert hole 11 of the machine housing 10 and its second plane 33 positioned in the interior of the machine housing 10 and in the recess 52 of the lower support cushion 50. At this time, the head 62 of the bolt 61 closely pushes against the bottom side of the second plane 33 of the lower saucer-shaped plate 30 and is completely positioned in the accommodating space 35 under the conical section 34, not protruding out of the machine housing 10.

As can be understood from the above description, this invention has the following advantages.

1. After the bolt 60 is locked by the nut 61, its head 62 is completely positioned and hidden in the accommodating space 35 under the conical section 34 of the saucer-shaped plate 30, not protruding out of the machine housing 10, able to maintain the smooth and beautiful appearance of an electric product or an electronic instrument., preventing the head 62 of the bolt 60 from being collided when the machine housing 10 is moved about to ensure stability of the annular transformers 20.

2. The bolt 60 is supported by the saucer-shaped plate 30 and locked on the machine housing 10, and its head 62 pushes against the second plane 33 of the saucer-shaped plate 30, and the first plane 32 of the saucer-shaped plate 30 closely pushes against the outer side of the machine housing 10. Therefore, the forceful stress produced by the bolt 60 to the second plane 33 can be distributed to the first plane 32 to prevent the lower saucer-shaped plate 30 and the machine housing 10 from being deformed, able to stabilize the bolt 60 and the annular transformers 20 and prolong the service life of the annular transformers 20.

While the preferred embodiment of the invention has been described above, it will be recognized and understood that various modifications may be made therein and the appended claims are intended to cover all such modifications that may fall within the spirit and scope of the invention.

I claim:

1. A device for combining annular transformers with a machine housing comprising a bolt to fix at least one annular transformer on a machine housing, said machine housing bored with an insert hole for said bolt to be inserted therethrough, said bolt having its upper end inserted through said machine housing and said annular transformers and locked by a nut, said annular transformers fixed on said machine housing by said bolt: and, Characterized by a saucer-shaped plate assembled on the outer side of said machine housing, said saucer-shaped plate bored with an insert hole in the center for said bolt to be inserted therethrough, said saucer-shaped plate having its outer annular portion formed with a first plane and its inner annular portion formed with a second plane which is higher than said first plane, said first and said second plane connected by an annular conical portion contracting gradually toward its upper side, said annular conical portion inserted through said insert hole of said machine housing and positioned in the interior of said machine housing, said bolt orderly inserted upward through said saucer-shaped plate, said machine housing and said annular transformers, said bolt having its upper end locked by said nut to fix said annular transformers on said machine housing, said bolt having its head completely positioned and hidden in an accommodating space formed under said conical portion of said saucer-shaped plate, said head of said bolt not protruding out of said machine housing.

2. The device for combining annular transformers with a machine housing as claimed in claim 1, wherein a reinforced plate is provided between said annular transformer and said machine housing and fitted through by said bolt, said reinforced plate having its opposite sides respectively bent upward to form a low sidewall.

3. The device for combining annular transformers with a machine housing as claimed in claim 1, wherein another saucer-shaped plate its inversely placed on said upper annular transformer.

4. The device for combining annular transformers with a machine housing as claimed in claim 1, wherein each said annular transformer has its upper and lower side respectively assembled thereon with a rubber support cushion, said rubber support cushion having a recess formed under and aligned to said saucer-shaped plate.

* * * * *